US006660938B2

(12) United States Patent
Herb et al.

(10) Patent No.: US 6,660,938 B2
(45) Date of Patent: Dec. 9, 2003

(54) SHAPED MOUNTING RAIL

(75) Inventors: Armin Herb, Apfeldorf (DE); Armin Hoffman, Landsberg (DE); Stefan Unverzagt, Penzing (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/229,701

(22) Filed: Aug. 27, 2002

(65) Prior Publication Data

US 2003/0042033 A1 Mar. 6, 2003

(30) Foreign Application Priority Data

Aug. 30, 2001 (DE) ..... 101 42 556

(51) Int. Cl.[7] ..... H01B 3/00

(52) U.S. Cl. ..... 174/68.1; 174/101; 174/72 A; 174/97; 248/49; 248/68.1; 52/220.3

(58) Field of Search ..... 174/68.1, 101, 174/68.3, 72 R, 97; 248/49, 68.1; 52/220.3; 439/210

(56) References Cited

U.S. PATENT DOCUMENTS 5,359,143 A * 10/1994 Simon ..... 174/68.1 X
5,869,786 A * 2/1999 Jaakkola et al. ..... 174/68.1 X
5,969,292 A * 10/1999 Snider, Jr. et al. ..... 174/48
6,437,247 B1 * 8/2002 Holliday ..... 174/101

* cited by examiner

*Primary Examiner*—Dhiru R. Patel
(74) *Attorney, Agent, or Firm*—Sidley Austin Brown & Wood, LLP

(57) ABSTRACT

A mounting rail with a C-shaped cross-section extends in a length dimension (L) and has a rear or second wall (2) with side walls (1*a*, 1*b*) extending at right angles to the second wall. Each side wall (1*a*, 1*b*) has on its exterior surface (5) a recess (3) running in the length dimension (L), whose cross-section is essentially rectangular. To assure optimum stability of the mounting rail, the depth (t) of the recess (3) is less than the wall thickness (d) of the side walls (1*a*, 1*b*).

3 Claims, 1 Drawing Sheet

SHAPED MOUNTING RAIL

BACKGROUND OF THE INVENTION

The invention relates to a mounting rail with a rail body having a length dimension and being approximately C-shaped in cross-section and formed of a rear or second wall and with side walls extending perpendicularly to the second wall and having a certain thickness. The side walls on their exterior surfaces have slot-like recesses extending in the length dimension with a certain depth relative to the side wall thickness.

The mounting rail described above has uses including, for example, mounting applications in the electrical and health fields, in the area of heating and in ventilation and air conditioning engineering. To provide the greatest flexibility, for example in laying cables, piping and the like, these are not installed directly on a wall, ceiling or floor but mounting rails are initially installed and suitable fastening elements are attached on the rails for cable, piping, and the like. The use of mounting rails makes it possible to quickly and easily shift fastening points for cable, piping and the like without having to create new bore holes for anchoring the fastening elements. The fastening elements can be simply displaced along the mounting rail and secured at the desired location. Mounting rails are used also for other applications, for example suspending hung ceilings, to flexibly mount and locate lighting fixtures, and the like. Mounting rails can be used everywhere, where great flexibility in the arrangement of fastening or mounting points is desired.

For example, DE 298 23 181 discloses a mounting rail with a C-shaped cross-section comprised of a rear wall and side walls projecting at right angles to the rear wall. Further, the side walls of the mounting rail are provided with recesses that extend along the length of the mounting rail and exhibit a swallow-tail shaped cross section. The depth of the recesses is dimensioned in such a fashion that they do not exceed the height of the recess normally extending to the rear wall.

The advantage of the known mounting rail is that mounting pieces can be fastened also along the side walls. Further, by virtue of the formation of a recess on each of the side walls the resistance of the side walls to torsional stress is increased and universal utilization is further assured, since the recesses extend into the internal space formed by the rear wall and the side walls.

The drawback to the known mounting rail is that the load perpendicular to the rear wall deteriorates slightly in relation to the wall thickness of the mounting rail, in particular that of the side walls, since the recess with this type of loading results in a weakening of the side walls.

SUMMARY OF THE INVENTION

The primary object of the present invention is to provide a mounting rail with a C-shaped cross-section whose load bearing capacity, in particular its torsional load capacity, is high and which is universal in its usability.

The object is achieved by the present invention in that the depth of the recess is smaller than the side wall thickness.

In addition to the high torsional resistance, the mounting rail also has high load carrying capacity perpendicular to the rear wall by virtue of the fact that the depth is formed in this fashion. Further, a result of dimensioning of the recess in the range of the wall thickness also makes manufacturing of the mounting rail more economical, since the recess can be formed by using a simple roller process.

The recess advantageously has a width measured perpendicular to the length dimension in the range of 0.25 to 0.75 times the extent of the side wall height measured perpendicular to the rear wall in order to afford the mounting wall with maximum stability.

The cross-section of the recess perpendicular to the length dimension is configured preferably rectangular in order to assure simple and thus economical manufacture of the mounting rail.

BRIEF DESCRIPTION OF THE DRAWING

The invention is more completely explained in the following read together with an exemplary embodiment, wherein.

DETAILED DESCRIPTION OF THE INVENTION

Figure 1:
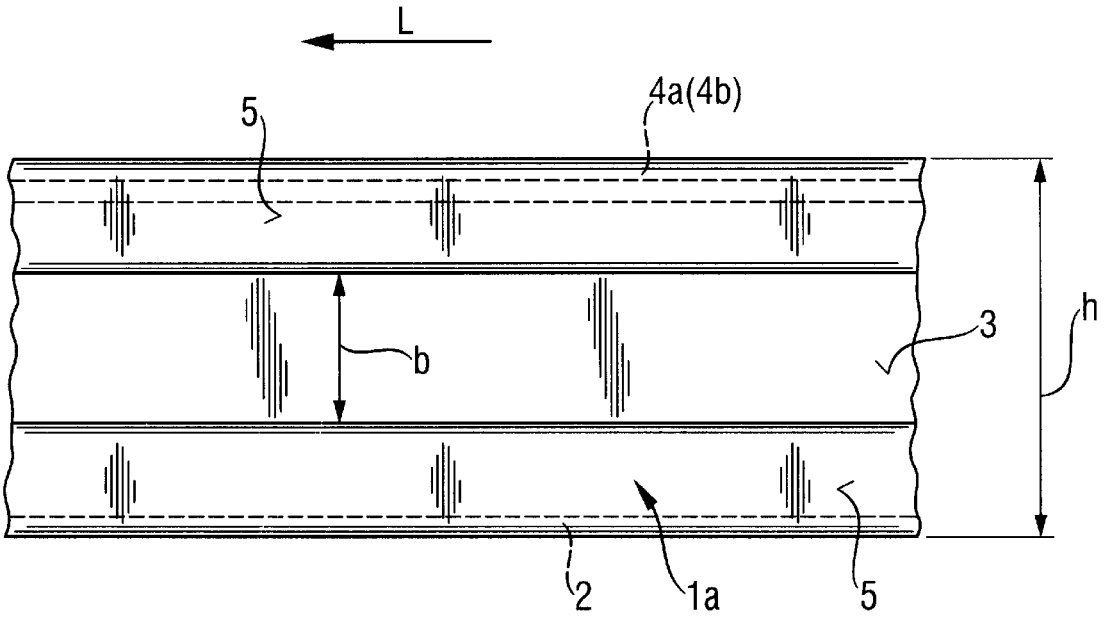
FIG. 1 is a partial side view of a mounting rail embodying the invention.
Figure 2:
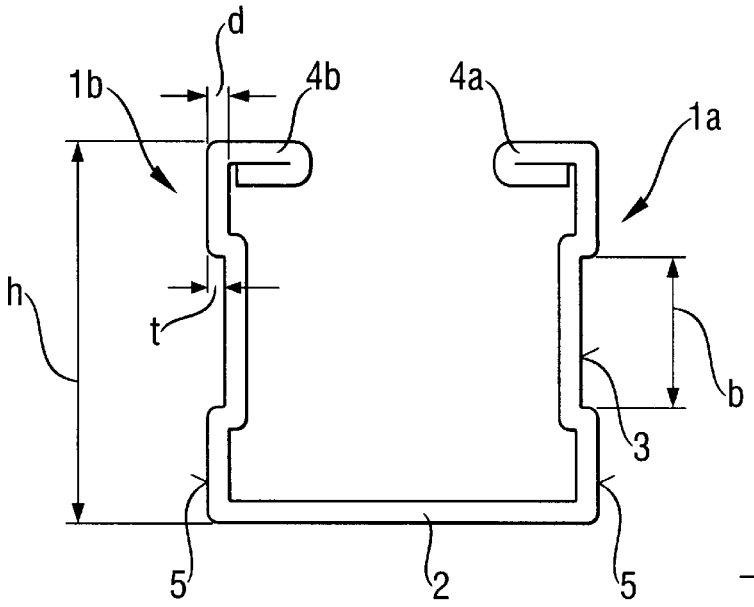
FIG. 2 is a transverse cross-section of the mounting rail shown in FIG. 1.

A mounting rail, according to the invention, is shown in FIG. 1 and 2 and is comprised of an elongated rail body having an approximately C-shaped cross-section with a rear or second wall 2 and side walls 1*a*, 1*b* extending at right angles to the second wall.

Side walls 1*a*, 1*b* have a wall thickness d and at their free ends opposite the second wall 2 form webs for a first wall 4*a*, 4*b* running essentially parallel to the second wall 2, their exterior surfaces 5 form a groove-like recess 3 running in the length dimension L and have a depth t of essentially rectangular cross-section. The side walls 1*a*, 1*b* extend essentially parallel to each other.

The recess 3 has a width b measured perpendicular to the length dimension L; the width corresponds to 0.6 times the height h of the side wall 1*a*, 1*b* measured perpendicular to the second wall 2. The depth t of the recess corresponds approximately to 0.9 times the wall thickness of the side walls 1*a*, 1*b*.

Preferably the mounting rail is formed from a single sheet of galvanized or rust-resistant steel plate , with the side walls 1*a*, 1*b* arranged at right angles to the second wall 2. The webs 4*a*, 4*b* have a greater wall thickness than the side walls 1*a*, 1*b* which is achieved simply by doubling over the free ends of the side walls. The wall thickness d of the side walls 1*a*, 1*b* corresponds approximately to the wall thickness of the rear wall 3. By doubling over the free ends of the side walls 1*a*, 1*b*, the wall thickness of the webs 4*a*, 4*b* is approximately double the wall thickness d of the side walls. The side of the webs 4*a*, 4*b* facing the rear wall 2 can be provided with a border or serrations (not shown). The spacing between the doubled over webs 4*a*, 4*b* or first wall form by spaced apart webs having an opening into interior of the mounting rail.

What is claimed is:

1. A mounting rail comprises a single sheet of steel plate shaped to completely form an elongated approximately C-shaped hollow rail body having a length dimension (L) with an opening extending in the length dimension affording access through the opening to the interior of said hollow rail body for supporting various elements from said rail body, said rail body formed by a planar first wall form by spaced apart webs (4*a*, 4*b*) containing said opening, an opposite planar second wall (2) and a pair of spaced side walls (1*a*, 1*b*) disposed at right angles to said second wall (2) and to said first wall (4*a*, 4*b*) and having a wall thickness (d), said side walls (1*a*, 1*b*) bent inwardly at the ends thereof spaced from said second wall, said side walls (1*a*, 1*b*) having groove-like recesses (3) in exterior surfaces thereof and spaced between said first wall (4*a*, 4*b*) and said second wall with a depth (t) inwardly of the exterior surfaces of said side walls (1*a*, 1*b*) and the depth (t) being less than the wall thickness (d) of said side walls, and the inwardly bent ends of said side walls forming said first wall (4*a*, 4*b*) being bent inwardly toward one another and doubled over into surface contact with inner ends of said doubled over walls (4*a*, 4*b*) being spaced apart transversely of the length dimension (L) and having a thickness approximately double the wall thickness (d) of said side walls and forming therebetween said opening, and said recesses (3) have a width (b) perpendicular to the length dimension (L) in the range of 0.25 to 0.75 times the height (h) of said side walls extending between said first (4*a*, 4*b*) and second walls (2).

2. A mounting rail, as set forth in claim 1, wherein said recesses (3) perpendicular to the length dimension (L) are substantially rectangular.

3. A mounting rail, as set forth in claim 1, wherein said second wall (2) has a thickness corresponding to the thickness (d) of said side walls (1*a*, 1*b*).

* * * * *